United States Patent [19]

Wylie, Sr.

[11] 4,442,656

[45] Apr. 17, 1984

[54] FILLING AND SEALING MACHINE FOR PROVIDING A FLAT BOTTOM PACKAGE

[75] Inventor: James C. Wylie, Sr., Houston, Tex.

[73] Assignee: Universal Packaging, Inc., Houston, Tex.

[21] Appl. No.: 314,658

[22] Filed: Oct. 26, 1981

[51] Int. Cl.[3] ..... B65B 9/08; B65B 51/30

[52] U.S. Cl. ..... 53/552

[58] Field of Search ..... 53/551, 552, 525, 451, 53/550

[56] References Cited

U.S. PATENT DOCUMENTS

| | | | |
|---|---|---|---|
| 2,981,349 | 4/1961 | Douglas | 53/525 X |
| 3,426,499 | 2/1969 | Paige | 53/551 X |
| 3,552,081 | 1/1971 | Leasure | 53/552 X |
| 4,129,976 | 12/1978 | Gründler et al. | 53/552 |

FOREIGN PATENT DOCUMENTS

| | | | |
|---|---|---|---|
| 2229691 | 1/1974 | Fed. Rep. of Germany | 53/552 |

*Primary Examiner*—Horace M. Culver

*Attorney, Agent, or Firm*—Pitts, Ruderman & Kesterson

[57] ABSTRACT

An apparatus for forming a pliable package having a flat bottom is disclosed. The apparatus includes a hollow guide form (16). The guide form, in a preferred embodiment, has a rectangular cross-section. Also provided are means (2) for forming pliable sealable material (12) which is received from a continuous roll, around guide form (16) to form a continuous seamed packaging preform (30). Members (32), (34) are also provided for advancing the continuous packaging preform (3) such that a seamed preform (58) extends below bottom (20) of guide-form (16). A pair of opposing and movable tucking jaws (60) and (62) are located close to the bottom end (20) of guide-form (16). Each of the tucking jaws includes a pair of pointed extension members (68) and (70), and (72) and (74) respectively separated a selected distance, for contacting and partially collapsing preform (58) to form a tuck in the preform (58) when tucking jaws (60) and (62) are moved toward each other. A pair of opposing and movable sealing jaws (76) and (78) are located at 90° angles with respect to the tucking jaws. Sealing jaws (76) and (78) are moved toward each other such that they collapse preform (58) and provide a seal portion (96) of a selected width across preform (58). Also provided are means (104) and (106) which cut through the preform at the seal portion (96).

6 Claims, 7 Drawing Figures

FILLING AND SEALING MACHINE FOR PROVIDING A FLAT BOTTOM PACKAGE

DESCRIPTION

Technical Field

This invention relates generally to machines which fabricate packages out of a continuous roll of pliable heat sealable material such as PVC (polyvinyl-chloride) or cellophane and more particularly to apparatus and methods which fabricate a package, fill the package with a commodity, and then seal the package with heat. In this particular invention, the machine includes unique methods and apparatus for providing a flat bottom package formed of the pliable heat sealable material which can stand up on its bottom side and is suitable for stacking on a shelf.

Background Art

There are various types of "form, fill and seal" packaging machines now available on the market. These machines typically come in various sizes and are particularly useful for filling granular materials such as nuts, rice, wheat, etc. Light fluffy items such as popcorn, cheesepuffs and the like can also be filled by these machines. In general, the machines which are now available form a package from a roll of film such as PVC film or cellophane and then fill the package with a selected product. The package is then sealed such that the product is protected in an airtight manner from the environment. Such machines are particularly speedy and useful in the food processing industry as they can often operate up to speeds of 100 bags filled and sealed per minute.

Prior to the form, fill and seal machines now on the market, food products and other granular type products including hardware have been packaged in many forms such as cans, sealed boxes with liners, etc. However, these packaging techniques are usually expensive, since, for example, boxes with sealed liners require two different types of packaging materials. Packaging can be used to enhance the sale, and is therefore a most important aspect of a product; however, care must be taken to assure that the cost of the packaging does not increase the cost of the commodity or product to the extent that the marketing is deleteriously affected.

The form, fill and seal packages produced by presently available machines typically comprise a single layer of cellophane, PVC or other pliable film. All of these packages have the disadvantage that they cannot be stacked on a shelf in an upright manner such that the large surfaces of the package can be used for advertising brand names, identification, etc. That is, to date, known form, fill and seal packages necessarily must lay on their side so that only the sealed end or a portion of the side is visible when the packages are stacked.

Since it is desirable that a product be readily identifiable, and since the packaging itself typically provides a large surface area suitable for identifying a product and for placing required packaging information thereon, it is an object of the present invention to provide apparatus for providing form, fill and seal package which provides a flat bottom on the package such that the package can stand on its end. It is also an object of the present invention to provide a method and apparatus which allows more product to be contained in less packaging film, and which permits printing on four sides of the package.

It is still another object of this invention to provide methods and apparatus for providing a flat bottom package made of a pliable material which operates with increased speed and can be readily maintained.

DISCLOSURE OF THE INVENTION

Other objects and advantages will in part be obvious, and will in part appear hereinafter, and will be accomplished by the present invention which provides apparatus and methods for providing a flat bottom package from a continuous roll of heat sealable pliable material, and for sealing and separating the filled package from the continuous roll of material. The apparatus comprises a hollow guide form having a top and a bottom end which has a selected cross-sectional shape such as for example, a rectangular shape. A means is provided for forming the pliable heat-sealable material from a continuous roll of such material around the guide form to form a continuous seamed packaging preform which has the same cross-sectional shape as the guide form. Also included is an advancing means such that the continuous packaging preform formed from the continuous roll of pliable material may be advanced below the bottom end of the guide-form. A pair of opposing and movable tucking jaws are located at the bottom end of the guide form on each side such that the continuous preform extending below the guide form passes between the tucking jaws. Each of the tucking jaws include a pair of extension members which are usually parallel and separated a selected distance. Each of the pointed extensions of the tucking jaws are suitable for moving inwardly toward each other such that they contact and partially collapse the preform extending below the guide form so that a tuck is formed in the continuous preform. While the tucking jaws are in their inward position, a pair of opposing and movable sealing jaws, which usually seal by means of heat, and which are located proximate the bottom end of the guide form and the tucking jaws close to seal the lower end of the bag. These movable sealing jaws are located such that the continuous preform also passes between the opposing jaws such that the jaws may be moved inwardly to completely collapse a portion of the preform and provide a sealed portion of a selected width across the preform as they move toward each other and inbetween the parallel pointed extension members of the tucking jaws. After the sealing is complete, there is provided a means for cutting through the continuous packaging preform at the seal portion to separate the seal portion into a first and a remaining part such that the first part of the seal portion provides a square sealed top end of a package separated from the continuous preform and the remaining part of the sealed portion forms a sealed bottom end on the remaining end of the continuous preform suitable for providing a sealed square bottom for a subsequent package. In a preferred embodiment, a wiping member is provided such that after the sealing has been completed and the separation has taken place, and while the pliable material is still hot, the wiping member moves past the remaining part of the sealed portion and bends it to one side such that the completed package now has a substantially flat bottom suitable for stacking and standing.

BRIEF DESCRIPTION OF THE DRAWINGS

The above-mentioned features of the present invention will be more clearly understood from the consideration of the following description in connection with the accompanying drawings in which.

BEST MODE FOR CARRYING OUT THE INVENTION

Figure 1:
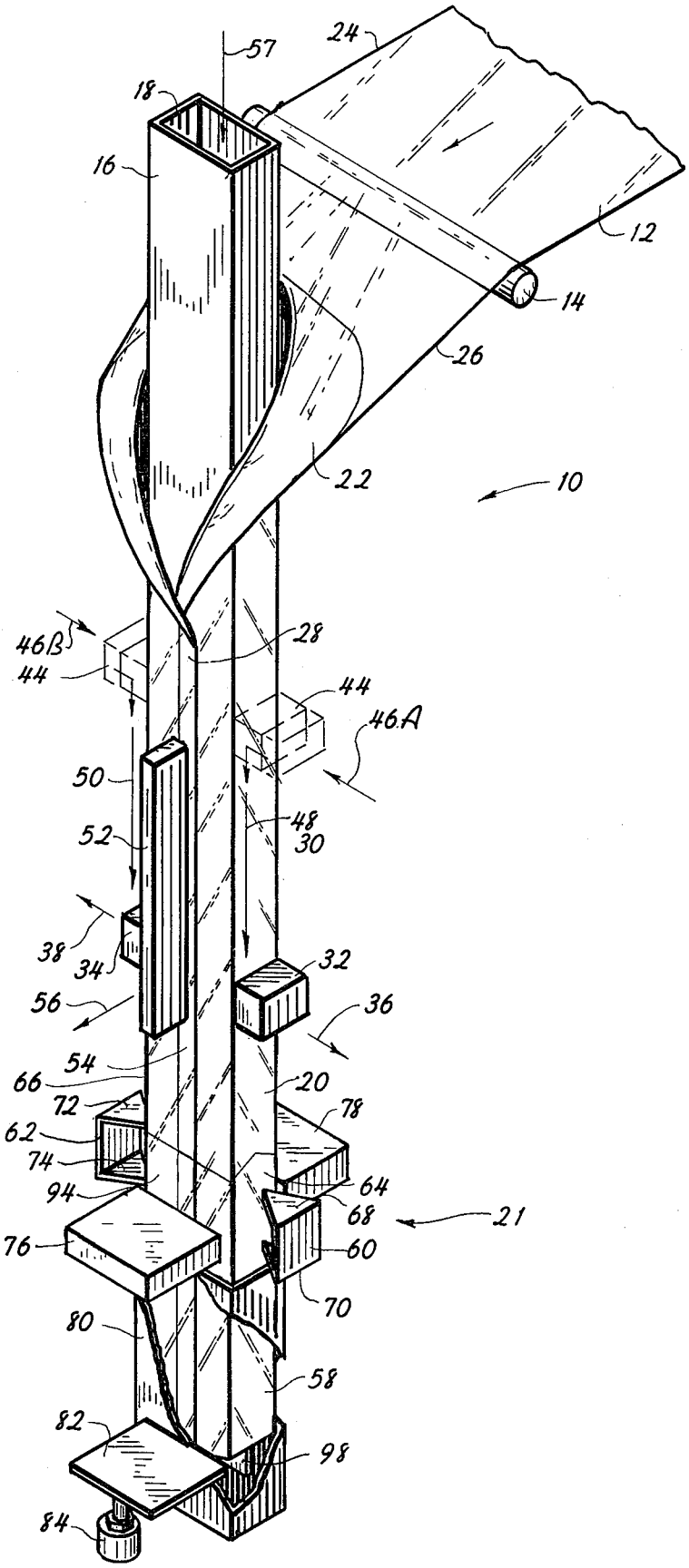
FIG. 1 is a pictorial view of the features of the form, fill, and seal machine of the present invention showing the pliable material being formed into a preform and the continuous preform being moved in position for a sealing operation.

Referring now to FIG. 1, there is shown a pictorial view of the filling and sealing machine of this invention generally at 10. As shown, a continuous roll of sealable, pliable material such as a film 12 is provided across tension roller 14 to the elongated guide form 16. Any pliable film such as PVC (polyvinyl-chloride) or cellophane, and which preferably is heat-sealable may be used as film 12. As shown, elongated guide form 16 is hollow, and in the embodiment shown has a rectangular cross-section. The guide form includes a top end 18 into which a commodity may be introduced to the interior of the guide form by means of a funnel (not shown) such that the commodity may advance and drop down the length of the guide form 16. Guide form 16 extends from its top end 18 to a bottom end 20 located proximate the tucking, cutting and sealing members shown generally at 21 which incorporate certain features of this invention. As can be seen, the pliable material or film 12 from the continuous roll of material is advanced over the tension roller 14 to a collar forming means 22. Collar forming means 22 forms and shapes the pliable material 12 such that the left hand edge 24 and the right hand edge 26 of the pliable material overlap such as is shown at seam 28, to form a packaging preform 30 having a cross-section substantially the same as the cross-section of the outside perimeter of the guide form 16.

Figure 2:
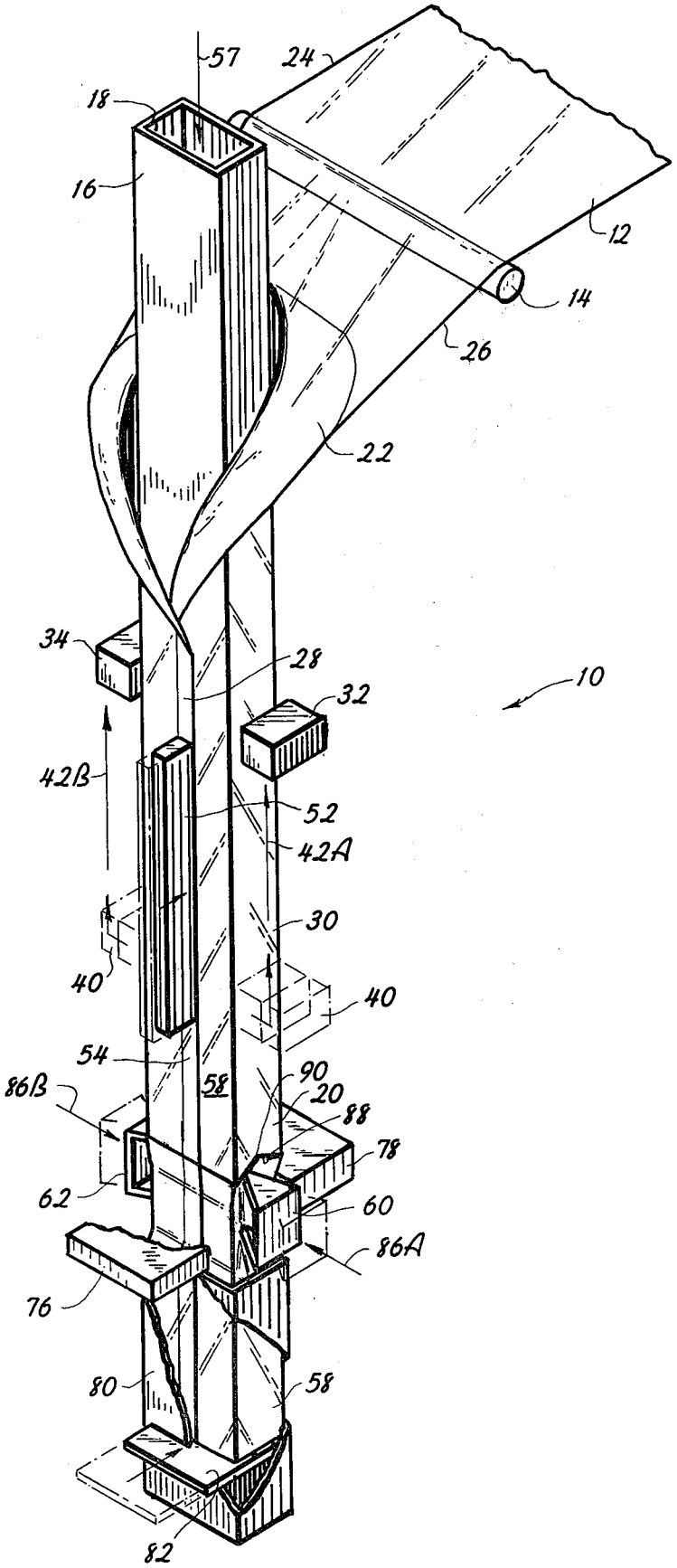
FIG. 2 shows a pictorial view similar to that of FIG. 1 wherein the sealing operation of the continuous preform has begun in that the tucking jaws have moved toward each other.

To move the preform 30 along after it is formed around guide form 16, a pair of nonslipping advancing members 32 and 34 are provided as is shown in both FIGS. 1 and 2. These members 32 and 34 are shown in their lowermost position in FIG. 1 and in an uppermost position in FIG. 2. In operation, these members will move outward away from the guide form 16 as is shown by arrows 36 and 38 of FIG. 1 such that they are no longer in contact with the film 12 or the guide-form 16. Once in the outward position 40 as indicated by the phantom lines of FIG. 2, the members then move upward as indicated by arrows 42A and 42B to the position shown in FIG. 2, and to the position 44 shown in FIG. 1 and indicated by phantom lines. Advancing members 32 and 34 then move inwardly again from the position shown in FIG. 2 as is shown by arrows 46A and 46B such that they again contact the continuous preform and are in position to move down as is indicated by arrows 48 and 50 in FIG. 1 such that the continuous preform 30 is advanced a selected distance.

Also as is shown, as preform 30 is advanced, the seam 28 advances between the guide form 16 and a heat sealing member 52. As the seam 28 of continuous preform 30 moves past heat sealing member 52, a permanent heat sealed seam 54 is provided. It will also be appreciated that while the contacting members 32 and 34 are moving in a downward motion such that they are advancing the preform 30 along guide form 16, sealing member 52 will be held firmly against the seam 28 to provide the heat seal seam 54. However, in an intermediate stage while the advancing members 32 and 34 are moving back to the starting or advancing position, heat sealing member 52 may be moved outwardly away from the guide form as indicated by arrow 56 to prevent excess heating while the preform is stationary on guide form 16.

Once the continuous seamed and sealed preform 58 has been advanced to a selected position, filling of the package is accomplished, as indicated by arrow 57, through the hollow of the elongated guide form 16 until the package has been filled with a desired quantity of commodity. Once the filling is complete, a final sealing and separating operation is undertaken. As shown, at the bottom end 20 of guide-form 16 there is a pair of opposing tucking jaws 60 and 62 located on each of the narrow sides 64 and 66 of packaging preform 58. As shown, both tucking jaws 60 and 62 include top and bottom pointed extension members 68 and 70, and 72 and 74 respectively. Also as shown in FIG. 1, a pair of heat sealing jaws 76 and 78 are located proximate the end 20 of elongated guide form 16 and according to the embodiment shown in FIGS. 1, 2, and 3 at a 90° right angle to tucking jaws 60 and 62. In the preferred embodiment, it will be appreciated that these sealing jaws 76 and 78 are heat sealing jaws such that they provide a selected amount of heat to seal a portion of the packaging preform 58. Also shown partially in FIGS. 1 and 2 and complete in FIG. 3, and as will be discussed in detail hereinafter, there is a support container 80 for receiving the continuous seamed package preform 58 prior to filling. A wiping member 82 and a vibrating member 84 for providing vibrating motion to wiping member 82 is also provided and will be discussed hereinafter. Once the package has been filled, the sealing process proceeds as follows. As shown in FIG. 1, the tucking jaws 60 and 62 are in an outermost position such that the continuous preform 58 is free to pass therebetween without obstructions. Once the continuous preform 58 has stopped and the filling completed, tucking jaws 60 and 62 are advanced inwardly towards each other such as shown by arrows 86A and 86B such that they contact the narrow sides 64 and 66 of the packaging preform 58 and partially collapse the packaging preform. To obtain a smooth fold or crease at the bottom of the continuous preform 58, elongated guide form 16 includes a bottom edge 88 having an indenture 90. Tucking jaws 60 and 62 are located in very close proximity to the end 88 of the elongated form guide 16 such that a smooth crease of the packaging preform is achieved as the tucking jaws move toward each other.

Figure 3:
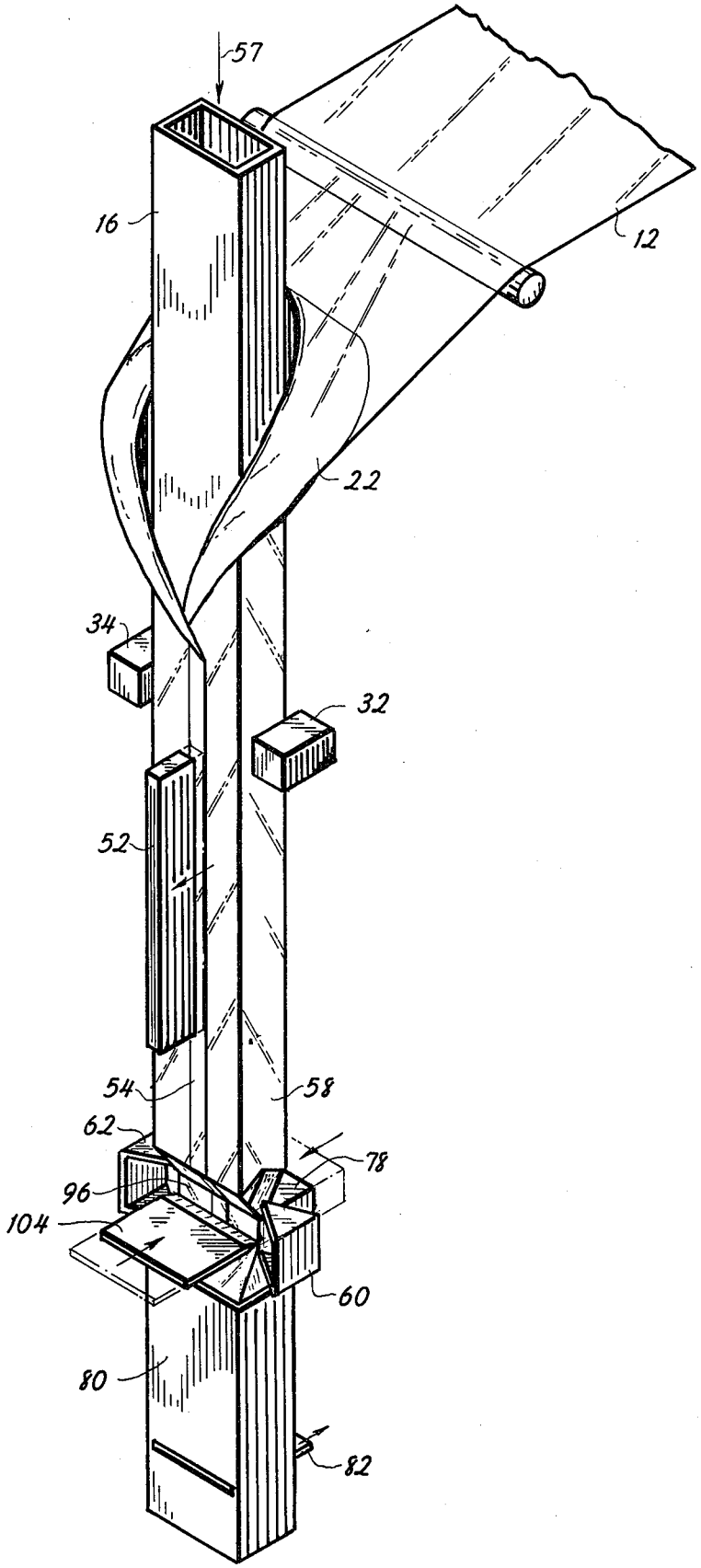
FIG. 3 shows a pictorial view similar to FIGS. 1 and 2 in which the filling operation has been completed, the sealing operation is being completed and the cutting or package separating operation is in progress.
Figure 4:
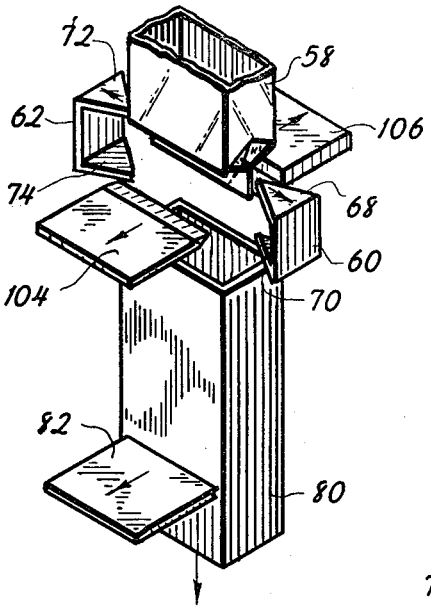
FIG. 4 shows details of the movable components which provide the tucking, the cutting operation, and the wiping operation of the filling and sealing packaging machine.
Figure 5:
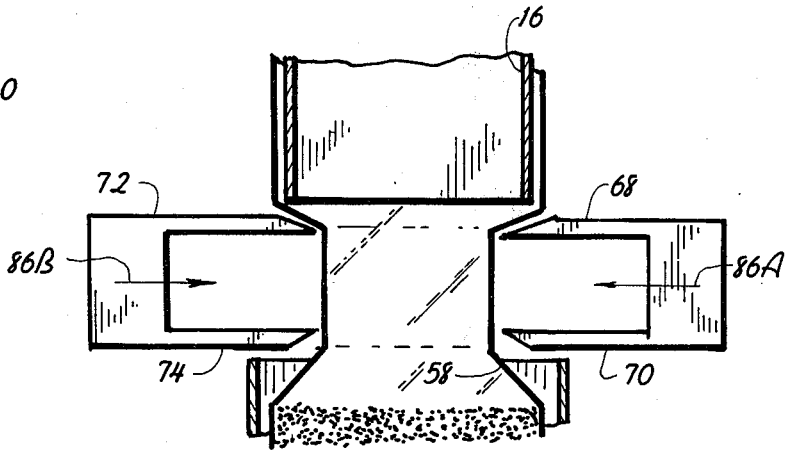
FIG. 5 is a cross-sectional view of the continuous preform through the tucking jaws, and shows details of the tucking operation.
Figure 6:
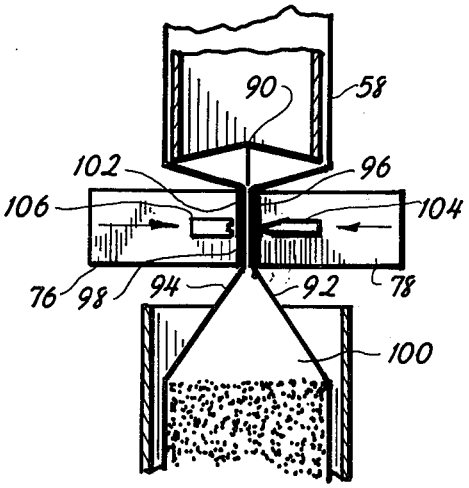
FIG. 6 is a cross-sectional view of the machine of this invention through the sealing jaws, and the continuous preform showing details of the sealing and cutting operation.

Referring now to FIG. 5, there is shown a cross-section through tucking jaws 60 and 62, guide form 16 and packaging preform 58 which clearly illustrates how the tucking jaws 60 and 62 partially collapse preform 58. While tucking jaws 60 and 62 are in their innermost position as shown in FIG. 5 and FIG. 2, sealing jaws 76 and 78 more clearly shown in FIG. 1 also start advancing toward each other to completely collapse the preform 58 such that the wide sidewalls 92 and 94 are pressed against each other. Referring now to FIG. 6, there is shown a cross-section through the prefrom 58 and the sealing jaws 76 and 78 which clearly show that sealing jaws 76 and 78 have advanced to their innermost position such that they are pressing firmly against the wide sides 92 and 94 of preform 58, and except for the material of preform 58 being in between, would substantially be in contact with each other. As seen in FIGS. 3, 5 and 6 the parallel extensions 68 and 70, and 72 and 74 of tucking jaws 60 and 62 have a spacing such that sealing jaws 76 and 78 slide therebetween to complete the sealing. It will also be appreciated, and as was discussed heretofore, sealing jaws 76 and 78 preferably apply heat to the heat sealing material of the continuous preform 58 to effect the seal. Thus, it will be appreciated, that sealing jaws 76 and 78 provide a seal portion 96 across continuous preform 58. Once the heat sealing is complete, the sealed portion 96 is then separated by a cutting means which cuts through the continuous preform 58 at the seal portion 96 leaving a bottom portion 98 attached to a sealed package 100 and a top portion 102 attached to the remaining end of continuous preform 58. In the embodiment shown in FIGS. 3 and 6, there is a cutting edge 104 and a receiving anvil 106 encased by sealing jaws 76 and 78. Sealing jaw 76 has been removed in FIG. 3 to more clearly show cutting edge 104. Thus, once the sealing is completed, the cutting edge 104 and the anvil 106 advance toward each other such that the continuous preform is separated through the sealed portion 96. It will be appreciated, of course, that instead of the cutting edge 104 and anvil 106 being included as a part of the sealing jaws, the separating and cutting by means of a cutting edge and anvil could take place at a later time after the package has moved or advanced to another step. The filling and sealing of the packages is a continuous process, and after a sealing and cutting operation is completed, the sealed package preferably passes wiping member 82, and the preform is advanced once more for another filling operation. While the bottom portion 98 of the sealed portion 96 is still hot it is advanced to the location such that bottom seal portion 98 is in the position shown adjacent wiping member 82 of FIG. 1. Wiping member 82 may simply provide a wiping action as shown in FIGS. 1, 2, 3 and 4 or may supply additional heat. While in the position shown in FIG. 3, wiping member 82 will support the package preform during the filling operation, at the same time, vibrator 84 can be used to vibrate the wiping member 82 such that proper settling of the commodity filling the package is effected. Although such vibration is not necessary for commodities such as rice, grains and heavy objects, filling the package with light objects such as popcorn, cheesepuffs and the like is best served by the use of the vibrating member. As is shown in FIGS. 1, 2 and 3, and more clearly in FIG. 4, supporting container 80 provides a supporting form for the pliable preform package as it is being filled by the machine. FIG. 4 also shows how the sealed remaining end of the container preform 58 is moved into supporting container 80 for filling after the top of the previous package has been sealed and the filled package has been advanced beyond the machine.

It will, of course, be recognized that it is not necessary that wiping member 82 act on the bag. For example, it may be desirable for the portion 102 of the bag to remain extended as shown in FIG. 4. To this end, the wiping or folding step is eliminated such that the bottom of the final bag product appears as is shown in FIG. 4.

Figure 7:
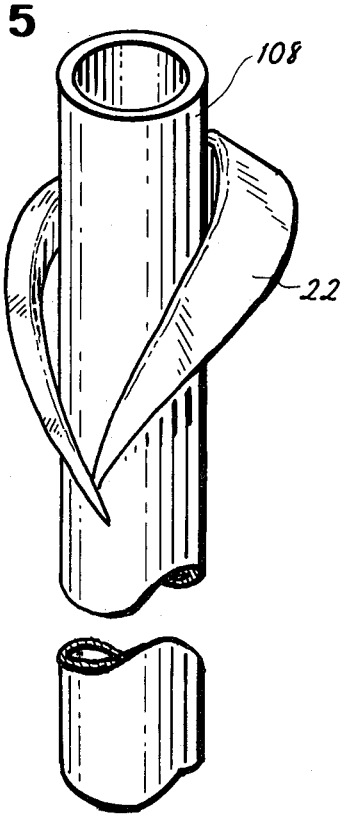
FIG. 7 is a pictorial view of an alternate embodiment of the guide form used in the apparatus of this invention which has a tubular shape.

Therefore, there has been described to this point, a form, fill and seal machine for use with a square elongated guide form 16 for providing a soft or pliable package having a rectangular cross-section and a flat bottom such that the package can be stored or set on a shelf in a vertical position. Although the preferred embodiment of this invention does disclose the use of a rectangular cross-section, it will be appreciated however, that packages having other cross-sections such as circular guide form 108 and as is shown in FIG. 7 can be obtained by using the methods and apparatus of this invention.

Thus, although the present invention has been described with respect to specific methods and apparatus for providing a forming, filling and sealing machine which preferably forms a flat bottom package from a pliable material, it is not intended that such specific references be considered as limitations upon the scope of this invention except insofar as is set forth in the following claims.

I claim:

1. A filling machine for forming a package from a continuous roll of heat sealable pliable material and for sealing and separating said filled package from said continuous roll of material comprising:

a hollow guide form having a top and bottom end and a selected cross-sectional shape;

means for forming pliable sealable material from a continuous roll around said guide form to form a continuous seamed packaging preform having said selected cross-sectional shape;

a pair of opposed advancing members intermediate said top and bottom ends of said guide form for advancing said preform such that a portion of said preform extends below said bottom end of said guide form, said advancing members adapted for simultaneous vertical movement and movement toward said guide form for grasping the exterior surface of said preform supported by said guide form during downward vertical movement of said advancing members, and movement away from said guide form during upward vertical movement of said advancing members;

a pair of opposing and horizontally movable tucking jaws located proximate said bottom end of said guide form such that said portion of said preform extending below said bottom end of said guide form passes therebetween, each of said tucking jaws including a pair of pointed extension members separated a selected vertical distance, and each of said pointed extension members of said tucking jaws suitable for contacting and partially collapsing said preform extending below said guide form to form a tuck in opposite sides of said preform when said tucking jaws are moved toward each other;

a pair of opposing and horizontally movable sealing jaws located proximate said bottom end of said guide form and said tucking jaws such that said portion of said preform extending below said guide-form passes therebetween, said sealing jaws suitable for collapsing said preform and providing a seal portion of a selected width across said preform by moving said sealing jaws toward each other and between said pointed extension members of said tucking jaws; and means for cutting through said continuous packaging preform at said seal portion to separate said seal portion into a first and remaining part such that said first part of said seal portion provides a square sealed top end of a package separated from said continuous preform and said remaining part of said sealed portion forms a sealed bottom end on said continuous preform.

2. The filling machine of claim 1 further comprising a wiping member for folding said remaining part of said sealed portion to provide a substantially flat bottom for said package.

3. The filling machine of claim 2 wherein said wiping member includes a vibrating means connected to said wiping member such that said wiping member can be used as a vibrating support as said package is being filled.

4. The filling machine of claim 1 wherein said pair of opposing moving sealable jaws provide heat to the package to achieve said sealed portion.

5. The filling machine of claim 1 wherein said guide form has a rectangular cross-section.

6. The filling machine of claim 1 wherein said guide form has a rectangular cross-section.

* * * * *